United States Patent [19]

Rhoads

[11] Patent Number: 4,601,268

[45] Date of Patent: Jul. 22, 1986

[54] VARIABLE TWO-WAY BLEED VALVE

[76] Inventor: Gary E. Rhoads, 8565 Boulder Dr., La Mesa, Calif. 92041

[21] Appl. No.: 583,997

[22] Filed: Feb. 27, 1984

[51] Int. Cl.[4] ..... F01L 1/24

[52] U.S. Cl. ..... 123/90.55; 123/90.57

[58] Field of Search ..... 123/90.48, 90.55, 90.52, 123/90.56, 90.57

[56] References Cited

U.S. PATENT DOCUMENTS

| | | | |
|---|---|---|---|
| 1,916,191 | 7/1933 | Burkhardt | 123/90.55 |
| 2,580,380 | 1/1952 | Banker | 123/90.55 |
| 2,691,367 | 10/1954 | Thoren | 123/90.55 |
| 2,940,433 | 6/1960 | Randol | 123/90.55 |
| 3,782,345 | 1/1974 | Erickson et al. | 123/90.48 |
| 4,223,648 | 9/1980 | Pozniak et al. | 123/90.55 |

FOREIGN PATENT DOCUMENTS

| | | | |
|---|---|---|---|
| 469928 | 12/1950 | Canada | 123/90.56 |

*Primary Examiner*—Craig R. Feinberg
*Assistant Examiner*—David A. Okonsky

[57] ABSTRACT

A new and useful two-way valve with an adjustable aperture, to work in combination with a hydraulic valve lifter in a combustion engine, and particularly that of a high performance engine, preventing valve overlap and shortening cam duration at low operating speeds. The two-way valve having an adjustable aperture restricted oil bleed passage way, leading to the pressure chamber allowing the lifter to bleed down, whereby the engine runs and operates at its perfected capabilities at low and high speeds. The passage way being adjustable for many cam profile characteristics, adjusted narrow enough allowing it not to bleed at a higher revolution per minute, consequently causing lifter pump up to a fully solid condition at higher engine speeds, and substantially incorporate an effective solid lifter action, but without pumping beyond its predetermined point of stability eliminating valve float which causes engine misfire. Due to these characteristics the engine runs more efficiently improving gas economy, burning the gases more thorough helps eliminate smog pollutant emissions.

4 Claims, 4 Drawing Figures

VARIABLE TWO-WAY BLEED VALVE

BACKGROUND AND SUMMARY OF THE INVENTION

With conventional types of hydraulic valve lifters, each valve actuating push rod seats in a plunger axially slidable in a lifter body, and the lifter body rides on one lobe of the cam. Oil from the engine lubrication system is introduced under pressure between the body and plunger, keeping the valve train at zero valve lash. Many lifters are designed to trap oil in the body chamber and pump up beyond its predetermined zero valve lash point, holding the valve open at high speeds causing valve float. However, with high preformance cams the valves are timed to have considerable overlap in order to provide for a large flow through the engine. At low speeds this large overlap is not necessary and the engine runs inefficiently, resulting in a loss in low speed horespower. Basically, increasing the valve lash will shorten valve open duration and reduce overlap, giving crankshaft rotating degrees in relationship to the opening of the valves. This will result in an improvement in low speed performance. However, excessive lash causes considerable noise and wear at idling and low speeds. The novel two-way valve varies valve timing automatically, by increasing or widening valve lash at low speeds improving low end torque horsepower, yet while the engine speed increases, the two-way valve allows the lifter to pump up, decreasing valve lash, consequently lengthing valve duration and overlap improving high speed performance.

The two-way valve described herein is designed to provide favorable characteristics over the other two patents. Herewith being much more precision, adjustable and readjustable for other cam profiles varing spring tension and oil weights, drop-in installation, also low cost manufacturing. A unique novel feature is that the two-way valve will in fact convert your own hydraulic lifter by the removal of the one way valve, and merely replacing it with the two-way valve converting your own lifters in a simple drop-in installation to a variable lifter, changing valve timing characteristics, improving engine performance, economy and smog pollutant emission factors.

BRIEF DESCRIPTION OF THE INVENTION

The present invention relates to hydraulic valve lifter and more particulary to variable valve lash timing lifters, by the inner component thereof.

The main feature of the invention resides in the provision of a two-way valve located in place of the one-way valve.

Another object of the ivention is the provision of an adjustable aperture on the secondary valve portion of the two-way valve.

Another object of the invention is the provision of a floating pin secondary valve, having snap ring grooves and located thereon a snap ring for quick and easy adjustments on the alternative two-way valve.

A further object of the ivention is the provision of a two-way valve, non adjustable as another alternative valve being a small bleed, a capillary tube.

DETAILED DESCRIPTION OF THE PREFERRED EMBODIMENTS

Figure 1:
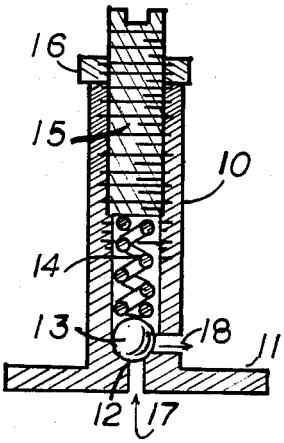
FIG. 1 is a section view of the novel adjustable two-way valve.
Figure 2:
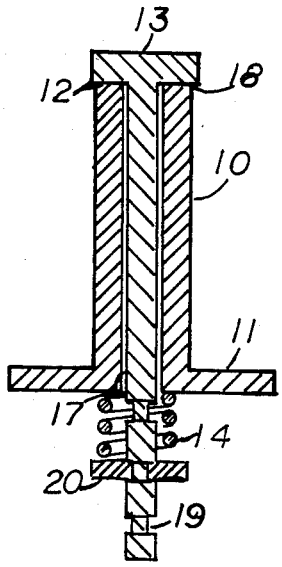
FIG. 2 is a sectional view of a alternative adjustable two-way valve.
Figure 3:
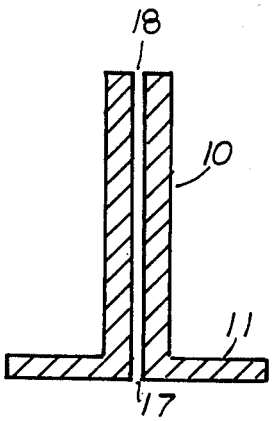
FIG. 3 is a sectional view of a further two-way valve non adjustable.
Figure 4:
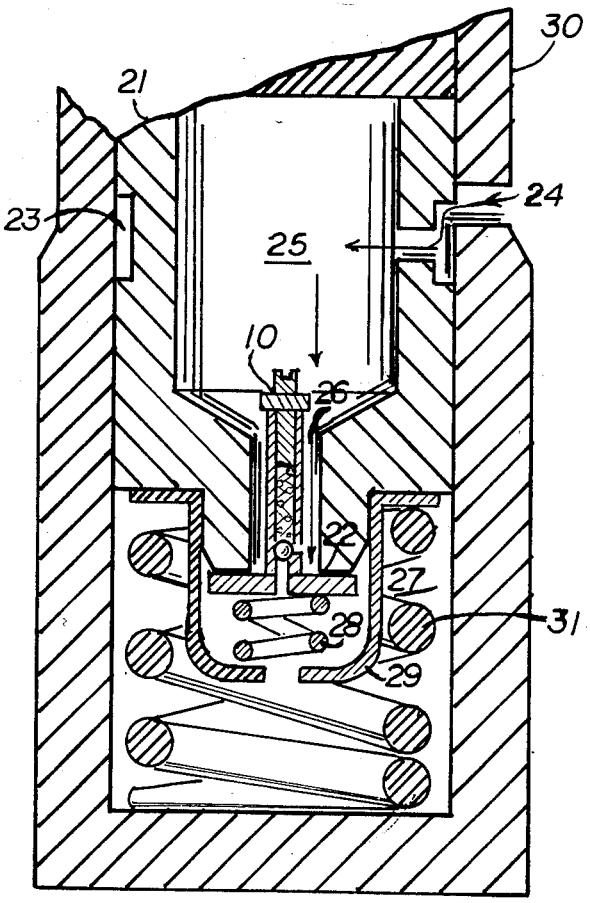
FIG. 4 is a sectional view of the lower portion of a hydraulic valve lifter showing the two-way valve in the slidable plunger.

FIG. 1 shows the preferred embodiment 10 while FIGS. 2 and 3 are alternative valve units corresponding to the numeral 10 preferred embodiments, the lower portion primary valve 11 of which engages with the primary valve seat 22 of FIG. 4. The internal hollow slidable plunger 21 has an outer perennial collecting channel 23 which registers with the supply duct 24 so that oil is continuously admitted into the inner chamber 25 of the plunger from the oil gallery regardless of any rotational or axial displacement experienced by the lifter components.

At the lower end of plunger 21 is a small outlet 26 having a valve seat 22 which is closed by a one-way check valve in previous hydraulic lifter patents. However, the novel two-way valve 10 replaces the old one-way valve having a primary valve 11 held in place against the primary seat 22 by a valve spring 28, the spring and valve being held in place by a perforated retaining cage 29.

The space between plunger 21 and the lower end of body 30 comprises a pressure chamber 27 and in this crucial chamber is a return spring 31 which biases the plunger 21 upwardly in the body 30, until stopped by the predetermined point of adjustment. In normal assembly the plunger 21 is depressed down against return spring 31 by the adjustment of the rocker arm and push rod, which is loaded by a much stronger valve spring on the cylinder head, not shown. The space between plunger 21 and the lower end of the body 30 said pressure chamber 27 is the crucial chamber whereby the oil is to bleed out through the novel two-way valve to reservoir 25. At low engine speeds the novel two-way valve 10 of FIG. 1 then plays a large important part thus allowing oil to be regulated out through aperture opening 17 pushing against secondary valve 13 and out through aperture bleed duct 18. A delay occurs while attempting to open the valves located on the cylinder head, oil is then bled off through the novel two-way valve 10 allowing the plunger 21 to lower until it bottoms thus opening the valves, this of course improves engine low end performance a great deal.

As engine r.p.m.s. increase, the secondary valve 13 is held in place with spring 14 and adjusted by a set screw 15 which is locked with lock nut 16. The valve 13 prevents oil from escaping on higher r.p.m.s due to the oil turbulence and time factors involved, causing a pump up action or lack of bleed, changing valve duration and overlap but not beyond its predetermined point of adjustment eliminating valve float. Alternative valve FIG. 2 operates on a similar principle, valve body embodiment 10 has a hole 17 through the center of said body. A valve pin 13 having multiple lower grooves 19 and a spring 14 is placed between said body and a fastening clip 20, thereby allowing oil to bleed at the proper pressure adjustment through aperture opening 17 and out aperture 18 pushing valve 13 up creating an escape. Alternative valve FIG. 3 is non adjustable, it bleeds out a restricted capillary tube with no internal working parts.

The novel two-way bleed valve engaged herein with a hydraulic valve lifter therefore can be adjusted before installation by pressure testing for proper bleed rates to correspond with proper cam profiles and other variables.

The action is provided by a precision two-way valve 10 allowing the proper adjusted oil bleed rate.

The valve lifters previously mentioned, U.S. Pat. No. 3,304,925 and U.S. Pat. No. 3,921,609 provide a bleed passage way, however not adjustable or a drop in installation. The one Pat. No. 3,921,609 shows a drop in wafer of which proved out unfavorable, the wafer being of thin construction, yet the hole being micro diameter failed to function with the lack of oil turbulance or friction. U.S. Pat. No. 3,304,925 has a slot on the side wall creating a struggle for the oil trying to escape, the friction allowing it to pump up at higher speeds. Consequently the two-way valve FIG. 3 is non adjustable and proves to work superior over the above mentioned alternative wafer of lack of oil turbulance and friction, FIG. 3 due to the oil struggle involved to escape through the added capillary tube 17 proves successful and low cost manufacturing, yet FIG. 2 is much simpliar adjustment than FIG. 1 having a adjusting valve 13 held by a spring in a snap ring 20 in a choice of adjusting grooves 19 allowing oil to flow through aperture opening 17, and out 18 aperture bleed duct.

The device as shown can of course be modified within the scope of the appended claims and specifically here are some modifications which might be desirable.

The unit embodiment 10 can also be a two piece unit, lower primary valve and secondary valve separate parts, with a precision fit wafer on said secondary valve body 10 having a lower machined peripheral area. Having a machined groove similar to FIG. 2 except on the body, holding the wafer to said body and clip. A second clip on an upper portion of body 10 just below secondary valve seat 12 so as to hold spring 28 between said clip and internal plunger 21 in the reservoir area 25, eliminating lower spring 28 and support cage 29, these alternative embodiments not shown.

FIG. 3 for example, may have a jet inserted in the top or sides thereof restricting the oil bleed even further. Varing sizes of replacement jets would be available. FIG. 2 may have many ways of construction, tappered countersunk head, escape holes, grooves or even jets on the secondary valve thereof. FIG. 1 may have ways of escape other than numeral 18, escape may travel up through a bleed escape area located through the top of set screw.

Although I have described my invention with a certain degree of particularity, it is understood that the present disclosure has been made only by way of example and that numerous changes in the details of construction and the combination and arrangement of parts may be restored to; without departing from the spirit and scope of the invention as hereinafter claimed.

What is claimed is:

1. A hydraulic valve lifter comprising:

a hollow tubular body closed at its bottom end, said tubular body having a predetermined internal diameter;

a slidable plunger having an external diameter slightly smaller than the internal diameter of said tubular body, said plunger having a hydraulic fluid chamber formed therein, a valve seat formed on a bottom surface of said plunger, a bore hole connecting said valve seat with said hydraulic fluid chamber, said plunger being slidably supported within said tubular body at a position spaced from said bottom end thereby forming a hydraulic fluid pressure chamber between the plunger and the bottom end of said tubular body;

means for supplying hydraulic fluid from the outside of said hollow tubular body to the hydraulic fluid chamber inside said plunger;

valve means extending into said bore hole having an internal bypass passage and also seatable against said valve seat for varying engine valve timing automatically by increasing valve lash at low speeds, thus improving low end torque horsepower, and which when the engine speed increases it decreases valve lash, consequently lengthening valve duration and overlap, thus improving high speed performance wherein said bypass passage allows fluid passage therethrough when said valve is in a seated position;

a perforated retaining cage is positioned against the bottom of said plunger, a return spring has its top end in contact with said retaining cage and its bottom end in contact with the bottom end of said tubular body; and a valve spring having its top end pressed against said valve means and its bottom end pressed against said retaining cage.

2. A hydraulic valve lifter as recited in claim 1 wherein said valve means comprises a two-way valve having a disc shaped base with a tubular neck portion extending upwardly therefrom, a diameter of said tubular neck portion is less than a diameter of the bore hole in the bottom end of said plunger so that hydraulic fluid can flow freely through said bore hole when said two-way valve is in an unseated position, said bypass passage including an aperture which is formed in the center of said disc shaped base and communicates with a radial bleed duct in the tubular neck portion, the bypass passage of said tubular neck portion being in communication with the aperture in said base and also said radial bleed duct, a top end of the bypass passage of said tubular neck portion being threaded and receiving a set screw therein that is adjustable upwardly and downwardly, a ball valve is located in a bottom portion of the bypass passage of said tubular neck portion and a spring is positioned between a top of the ball valve and a bottom of said set screw.

3. A hydraulic valve lifter as recited in claim 1 wherein said valve means comprises a two-way valve having a disc shaped base with a tubular neck portion extending upwardly therefrom, a diameter of said tubular neck portion is less than a diameter of the bore hole in the bottom end of said plunger so that hydraulic fluid can flow freely through said bore hole when said two-way valve is in an unseated position, the bypass passage extending through said tubular neck portion and being in communication with an aperture in the center of said disc shaped base, a secondary valve having a cylindrical body with a disc shaped head formed at its top end, a bottom end of said cylindrical body having a series of longitudinally spaced annular grooves, a clip is snapped into one of said grooves, and a coil spring is mounted on said cylindrical body between a top surface of said clip and a bottom surface of said disc shaped base.

4. A hydraulic valve lifter as recited in claim 1 wherein said valve means comprises a two-way valve having a disc shaped base with a tubular neck portion extending upwardly therefrom, a diameter of said tubular neck portion is less than a diameter of the bore hole in the bottom end of said plunger so that hydraulic fluid can flow freely through said bore hole when said two-way valve is in an unseated position, the bypass passage extending through said tubular neck portion and being in communication with an aperture in the center of said disc shaped base such that the aperture and passage function as a capillary tube.

* * * * *